US005101727A

United States Patent [19]

Yarrington

[11] Patent Number: 5,101,727

[45] Date of Patent: Apr. 7, 1992

[54] ELECTRO-OPTICAL DETONATOR

[75] Inventor: Arthur G. Yarrington, Crows Nest, Australia

[73] Assignee: Richard John Johnson, Australia

[21] Appl. No.: 622,463

[22] Filed: Dec. 5, 1990

[30] Foreign Application Priority Data

Dec. 14, 1989 [AU] Australia ..... PJ7865

[51] Int. Cl.[5] ..... F42C 19/00

[52] U.S. Cl. ..... 102/201

[58] Field of Search ..... 102/200, 201, 202.1, 102/202.5, 206

[56] References Cited

U.S. PATENT DOCUMENTS 3,408,937 11/1968 Lewis et al. ..... 102/201
3,812,783 5/1974 Yang et al. ..... 102/201
4,145,970 3/1979 Hedberg et al. ..... 102/206
4,403,143 9/1983 Walker et al. ..... 102/201
4,757,764 7/1988 Thureson et al. ..... 102/275.8
4,870,902 10/1989 Simon et al. ..... 102/201
4,984,518 1/1991 Yarrington ..... 102/201

*Primary Examiner*—Charles T. Jordan
*Attorney, Agent, or Firm*—Armstrong, Nikaido, Marmelstein, Kubovcik & Murray

[57] ABSTRACT

The invention relates to an Optical Detonator including a provision to accept a fiberoptic light guide cable 2 within a terminal socket 12 whereby an electromagnetic radiation signal passed down the fiberoptic light guide cable 2 activates a photo-conductor device 16 located within the hollow body portion 3 of the detonator 1 to allow an adjacent primary battery device 20 as the electrical energizing source to pass an electric current through fusehead $\frac{7}{8}$ to fire the detonator.

9 Claims, 1 Drawing Sheet

ELECTRO-OPTICAL DETONATOR

FIELD OF INVENTION.

This invention is concerned with a detonator for explosive compositions and in particular is concerned with a detonator which employes as a fail safe device, an optically actuated switching means to close an electrical energizing circuit.

BACKGROUND OF THE INVENTION

Electrically actuated detonators comprising a thermo-resistive element coated with an initiating "flashing" pyrotechnic compound are well known. Such devices are inexpensive to manufacture and are known to be extremely reliable in use as well as relatively safe in storage and handling.

Electrical detonators have a major disadvantage in that they require connection via electrically conductive cables to a remote detonating device providing a source of electrical energy. Accidental explosions have been attributed to spurious electrical currents induced or conducted in the electrical conductors by electrical machinery, static earth charges, lightning, high voltage transmission line corona discharge, radio frequency transmission and the like.

In an endeavour to overcome the dangers associated with conventional electrically actuated detonators of the type described above, various non-electric systems have been proposed.

One type of non-electrically actuated detonator described in the known patent specifications relating to blasting detonators systems employs a tubular lead, the inner surface of which is coated with a deflagrating material. When the deflagrating material is fired at a remote end of the tubular lead, a shock wave is propagated down the interior of the tubular lead to detonate the explosive composite of the detonator. A non-electrical blasting initiating system of this type is described in U.S. Pat. No. 4,757,764.

While generally effective for its purpose and relatively safe in use such non-electric initiating systems have been the cause of a number of large blast project failures and are limited to a short shelf life. The system is complicated to systemize with a shock wave speed of 1.8 kilometers per second compared to 300,000 kilometers per second for optic initiation.

Swedish patent application number 8,503,595 describes a fiber optic ignition system for explosive compositions wherein optical energy is converted by a photo-voltaic cell into electrical energy. The electrical energy is amplified and stored in a capacitor for selective release via electrical conductors to a conventional electric detonator. While this system avoids the necessity for long electrical conductors between the detonator and the remote initiating position (with the attendant risks described above) the requirement of expensive fiber-optic cables capable of transmitting a large amount of energy to charge the capacitor, with its ability to hold the full charge for only a short period. The firing of the detonator would require a further signal from the remote triggering station.

The formation of a continuous electrically conductive circuit between the electrical switching means of the optical initiating device and the detonator is considered to pose an unacceptable risk of premature detonation from spurious induced or conductive currents in the electrical conductors.

U.S. Pat. Nos. 3812783,4403143 and 3408937 are illustrative of non-electric blast initiation systems employing high intensity laser radiation transmitted via an optical fire cable to a detonating device.

Prior art blast initiating systems employing Laser energy as a sole energizing source are relatively safe in use but currently uneconomical in use and of dubious reliability.

It is an aim of the present invention to overcome or alleviate the problems of prior art blast initiation systems and to provide a safe, reliable and economic explosive detonator and initiation system therefore.

SUMMARY OF THE INVENTION

According to one aspect of the invention there is provided a detonator comprising:

- a hollow body portion containing adjacent a closed end thereof a quantity of explosive material;
- an electrical resistance element spaced from a quantity of explosive material, which may be combined with an optional deflagrating chemical time-delay charge to fire the main detonating charge; the electrical resistance element having associated therewith a quantity of thermally energizable initiating pyrotechnic material; and, a switching device responsive to electromagnetic radiation.
- a contained primary battery device as the electrical energizing source;
- a terminal socket located within the proximal end of the detonator hollow body portion to securely accept the terminal plug attached to the distal end of the fiberoptic light guide cable. The switching device responsive to electromagnetic radiation is coupled with a primary battery device and the electrical resistance element. The switching device when actuated by the correct radiation signal closes an electrical circuit associated with the resistance element and primary battery device whereby the pyrotechnic fusehead is thermally ignited.

Preferably the electromagnetic radiation responsive switching device comprises a photo-conductive device.

BRIEF DESCRIPTION OF THE DRAWING

In order that the invention may be more clearly understood, reference will now be made to a preferred embodiment illustrated in the accompanying drawing.

DETAILED DESCRIPTION OF THE INVENTION

Figure 1:
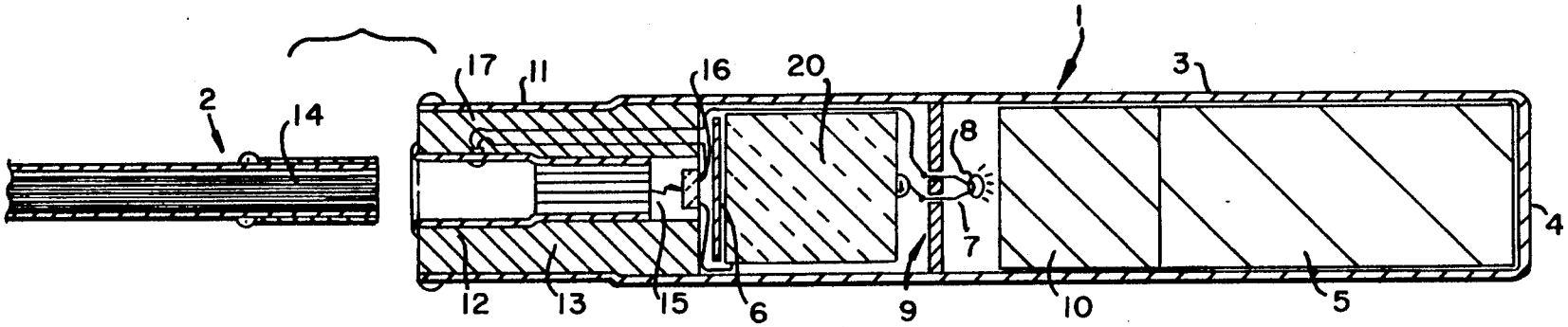
FIG. 1 shows a typical embodiment of the device of the invention.

The drawings illustrate in cross-section a detonator 1 and portion of a free end of a fiberoptic light guide 2, as a schematic projection.

Detonator 1 comprises a hollow body portion 3 having a closed distal end 4 adjacent which is located a quantity of explosive chemical material 5. Chemical time-delay deflagrating material 10 may be optionally incorporated adjacent to the detonating material 5.

An insulating means 9 supports the electrical resistance element 7 which is coated with a chemical deflagrating pyrotechnic material 8 of the type commonly employed in prior art electric detonators to initiate fusion of the detonating material 10 and 5.

The electrical resistance element 7 coated with a thermally ignitable pyrotechnic material 8 as the "fusehead", is spaced from a quantity of chemical explosive material 10 and 5 placed adjacent to closed end 4 of the elongated body portion 3 of detonator 1. A quantity of chemical explosive material 10 and 5 may consist of more than one part compounded as a quantity of deflagrating pyrotechnic chemical time-delay material 10 placed adjacent to a quantity of detonating chemical explosive material 5, the quantity of deflagrating pyrotechnic chemical time-delay material 10 would be spaced from the pyrotechnic fusehead 8.

A primary battery means 20 contained adjacent to the electrical resistance element 7 would provide the electrical energy source to power the device. Activation of the circuit would occur when an electromagnetic radiation signal, sent down the fiberoptic light guide is engaged within the proximal end 11 of the detonator casing 3 to impinge at 15 on an adjacent placed photo-conducter device 16 such as a photo-diode or a photo-transister switching means responsive to electromagnetic radiation.

The primary battery means 20 will have a energy capacity level sufficient to heat the electrical resistance element 7 to provide thermal energizing of the resistance element 7 chemical pyrotechnic coating 8 to cause ignition of the adjacent explosive materials 10 and 5 contained within the detonator casing 3.

Primary battery means 20 may have an isolating switch means 17 incorporated in the electric circuitry layout. The switching means would be separate and additional to the electromagnetic radiation responsive switching means.

A terminal socket placed within the mouth at the proximal end of the elongated hollow body portion of the detonator casing is arranged to accept the mating terminal plug encasing the distal end of the fiberoptic light guide cable 2.

The isolating switch means incorporated in the primary battery mean 20 circuit may be located within the socket terminal 12 placed within the proximal end 11 of the detonator casing 3.

The isolating switch 17 would be in the normally "open" state and would be "closed" by the insertion of the fiberoptic light guide cable terminal plug 14 into the terminal socket 12 of the detonator.

The photo-conductor device 16 as the electromagnetic radiation responsive switching means is mounted within the hollow body portion 3 of the detonator near its proximal end 11 adjacent to the rear 6 of the terminal socket 12 whereby the radiation sensing area 15 of the photo-conductor switching means is in axial alignment with the optic fibers encased by the terminal plug 14 of the light guide cable when inserted into the terminal socket means 12 of the detonator.

In operation the photo-conducter device 16 of the detonator on receiving an electromagnetic radiation signal from the external radiation source by way of the connected fiberoptic light guide cable, triggers the electromagnetic switching means to allow a conductive circuit to be formed to pass an electric current from the primary battery means 20 through the electrical resistance element 7, thereby to ignite the thermal pyrotechnic chemical coating 8 to fire the detonator.

Preferably the external electromagnetic radiation source would be a laser device producing a radiation signal as a coherent monochromatic collimated energy beam. Due to the need only for low powered energy by the photo-conductive switching means within the detonator a low cost fiber-optic light guide cable would suffice.

The fiber optic light guide can be arranged as a suitable plug-in/adaptor means or be crimp sealed into the body portions 3 at the proximal end 11 of the detonator case.

It is understood the distal end of the fiber optic light guide would align with the optic sensing means of the photo-conductor switching means 16 to allow electromagnetic radiation energy such as infra-red radiation to impinge on the sensitive area of photo-conductor 16 such as a photo-diode or transistor to close the electrical circuit between the adjacent mounted primary battery and the circuit of the resistance element to fire the fusing means. This would only occur when the correct preselected radiation energy signal was sent down the fiber optic light guide from the firing station to the detonator.

In use the detonator 1 is connected to the free end of the optical conductor, the opposite end of the conductor is connected at a remote position to a source of electromagnetic radiation energy respectively controlled by the remote firing means.

It will be appreciated by a skilled addressee that even though the detonator according to the present invention is structurally and otherwise functionally identical to a prior art electric detonator, the inherent dangers associated with spurious electrical charges are avoided by the incorporation in the detonator of a switching means responsive to electromagnetic radiation to close the detonator in-housed electrical circuit of the primary battery means and the electrical element of the fusing means, guaranteeing no-risk of premature detonation of the device.

The detonator may be manufactured with a suitable length of fiber optic cable attached thereto, the free end of the fiber optic cable terminating in an optical coupling device.

Alternatively the detonator may be manufactured without a fiber optic cable attached. The plug 13 may be made of a resilient polymeric material or other deformable material with a central cable receiving aperture. Over the end of the plug 13 is a thin pierceable closure such as a plastics film or aluminium foil to protect the detonator against ingress of contaminants such as water, dirt etc.

In use the free end of a fiber optic-cable is pushed against the closure to pierce an aperture therein and the cable is then pushed through the aperture in plug 13 until the free end abuts against the inner wall. The resilient plug 13 firmly retains the fiber-optics cable.

In the variation described above, the use of expensive fiber optics couplers may be avoided.

The detonators according to the present invention thus possess the advantages of prior art electrical detonators in terms of reliability and economy but otherwise avoid the dangers inherent therein.

It will be clear to a skilled addressee that many modifications and variations may be made to the present invention without departing from the spirit and scope thereof.

The claims defining the invention are as follows:

1. A detonator comprising:

an elongated hollow body portion of a detonator casing with a closed end encasing a contained quantity of chemical explosive material adjacent to said closed end;

an electrical resistance element coated with a thermally ignitable pyrotechnic chemical material as a pyrotechnic fusehead spaced from said quantity of chemical explosive material;

a primary battery means contained adjacent to said electrical resistance element pyrotechnic fusehead;

an electromagnetic radiation responsive switching means contained adjacent to said primary battery means wherein electrical circuit connections allow a conductive circuit to be formed to pass an electric current from the primary battery means through the electrical resistance element, controlled by the electromagnetic radiation responsive switching means in response to energization by a electromagnetic radiation signal from an external radiation source;

a terminal socket means placed within a mouth at a proximal end of the elongated hollow body portion, to accept a terminal of a fiberoptic light guide cable;

an isolating switch means incorporated in the primary battery means, said isolating switch means being separate and additional to said electromagnetic radiation responsive switching means.

2. A detonator as claimed in claim 1 wherein said quantity of chemical explosive material may consist of more than one part, compounded as a combination of a quantity of deflagrating pryotechnic chemical time-delay material placed adjacent to a quantity of detonating chemical explosive material, said quantity of deflagrating pyrotechnic chemical time-delay material being spaced from said pyrotechnic fusehead.

3. A detonator as claimed in claim 1 wherein the electromagnetic radiation responsive switching means has a radiation sensing area in axial alignment with optical fibers encased by a terminal plug of the light guide cable when inserted into the terminal socket means of the detonator.

4. A detonator as claimed in claim 1 wherein the primary battery means has an energy capacity level sufficent to heat the electrical resistance element to provide thermal energizing of the elements chemical pyrotechnic coating.

5. A detonator as claimed in claim 1 wherein said isolating switch means incorporated in the primary battery means is separate from and additional to the electromagnetic radiation responsive switching means, the isolation switch means is in a normally "open" state and is "closed" by insertion of a fiberoptic light guide cable terminal plug into the terminal socket means of the detonator.

6. A detonator as claimed in claim 1 wherein said electromagnetic radiation responsive switching means comprises a photo-conductive device.

7. A detonator as claimed in claim 6 wherein said photo-conductive device comprises a photo-diode.

8. A detonator as claimed in claim 6 wherein said photo-conductive device comprises a photo-transister.

9. A detonator as claimed in claim 6 wherein said electromagnetic radiation responsive switching means is responsive to electromagnetic radiation from a laser device.

* * * * *

UNITED STATES PATENT AND TRADEMARK OFFICE

CERTIFICATE OF CORRECTION

PATENT NO. : 5,101,727

DATED : April 7, 1992

INVENTOR(S) : Arthur G. YARRINGTON

It is certified that error appears in the above-identified patent and that said Letters Patent is hereby corrected as shown below:

On the cover page, in Item [75], delete "Crows Nest" and insert therefor -- Wynnum Heights --.

Signed and Sealed this

Fifth Day of October, 1993

*Attest:*

*Attesting Officer*

BRUCE LEHMAN

*Commissioner of Patents and Trademarks*